United States Patent [19]

Atkins

[11] 4,266,297

[45] May 12, 1981

[54] BULLET RESISTANT BALLISTIC PANEL CARRIER GARMENT

[75] Inventor: John H. Atkins, Cincinnati, Ohio

[73] Assignee: A & B Industries, Inc., Cincinnati, Ohio

[21] Appl. No.: 47,896

[22] Filed: Jun. 12, 1979

[51] Int. Cl.[3] ..... F41H 1/02

[52] U.S. Cl. ..... 2/2.5; 2/94; 2/247

[58] Field of Search ..... 2/2.5, 2, 93, 22, 23, 2/24, 94, 247, 251; 161/404

[56] References Cited

U.S. PATENT DOCUMENTS

| | | | |
|---|---|---|---|
| 1,495,489 | 5/1924 | Krause | 2/2.5 |
| 2,448,416 | 8/1948 | Carter | 2/94 |
| 2,865,025 | 12/1958 | Hennessy | 2/94 |
| 3,135,098 | 6/1964 | Root | 2/247 X |
| 3,135,961 | 6/1964 | Roderick | 2/2 R |
| 3,452,362 | 7/1969 | Korolick et al. | 2/2.5 |
| 3,787,892 | 1/1974 | Quinn | 2/22 |
| 3,855,632 | 12/1974 | Davis | 2/2.5 |
| 3,950,789 | 4/1976 | Konz et al. | 2/93 |

*Primary Examiner*—H. Hampton Hunter
*Attorney, Agent, or Firm*—Simon Groner

[57] ABSTRACT

A bullet resistant ballistic panel shirt-like carrier garment having interior front and rear pocket-like receptacles receiving flexible ballistic panels for providing protection against firearm projectiles to the upper torso of the wearer. The panels may be easily removed from the carrier garment, and the garment worn as a conventional shirt.

9 Claims, 4 Drawing Figures

BULLET RESISTANT BALLISTIC PANEL CARRIER GARMENT

SUMMARY OF THE INVENTION

The alarming increase of violent crime in this country, particularly crimes involving firearms of the "Saturday Night Special" variety, has placed in serious jeopardy the lives and safety of law enforcement personnel continually confronted by life threatening situations. Numerous types of ballistic resistant devices such as shields, body armor, bullet resistant vests, and the like have been proposed for protecting law enforcement personnel. However, law enforcement personnel have learned from experience that such devices may be unnecessarily unwieldy and uncomfortable, and consequently are deterred from fully utilizing the protective apparatus.

For example, some types of ballistic resistant apparel are provided with metallic or ceramic coated panels which have considerable weight and seriously restrict the wearer's movements. As a result, the law enforcement officer may actually be hindered in his pursuit of a felon or in taking evasive action. Furthermore, certain types of protective devices require complex hook-up straps and other fastening devices which are uncomfortable, time consuming to apply, inhibit free body movement, and in general discourage full utilization of the protective device. It has also been found that some types of ballistic resistant apparel include seams which may permit penetration of a ballistic projectile.

The bullet-resistant ballistic panel carrier garment of the present invention overcomes the deficiencies of prior art protective devices by providing a comfortable, easily operated and effective ballistic panel carrier which actually encourages use by the wearer. In a preferred embodiment, the carrier comprises a shirt-like carrier garment similar to the standard law enforcement officer's uniform shirt having a substantially continuous back portion, a closable front portion forming left and right chest sections, and means such as a zipper or buttons for closing the front portion. A rear pocket-type rectangular-shaped ballistic panel receiving receptacle having an opening along one edge is attached to the inner surface of the back portion such that the opening is horizontally disposed when the garment is being worn. A front rectangular-shaped pocket-like ballistic panel receiving receptacle having an opening along one edge is attached to the inner surface of each of the left and right chest sections such that the front receptacle openings are in aligned facing relationship with each other when the garment is being worn. A flexible bullet resistant ballistic panel is slidably and removably received in the rear receptacle to provide protection for the upper rear torso of the wearer. A shaped flexible bullet resistant ballistic panel of similar construction is slidably and removably received in the front receptacles, such that a portion of the front panel is supported by each of the front receptacles when the front portions of the skirt-like carrier garment is closed to provide protection for the upper front torso of the wearer. As will become apparent from the detailed description which follows, this arrangement provides maximum protection for the wearer while facilitating insertion and removal of the ballistic panels in the carrier garment. Furthermore, the ease with which the carrier garment may be applied, fastened, and removed actually encourages its use. Inasmuch as the exterior appearance of the garment closely resembles the standard law enforcement uniform shirt, a separate carrier garment is not required as in prior designs, and in fact the carrier garment of the present invention may be worn without the bullet resistant ballistic panels in situations where such protection is not required. Furthermore, the casual observer is unable to discern that protective armor is being worn, which increases the officer's safety in sensitive confrontation situations.

DETAILED DESCRIPTION

Figure 1:
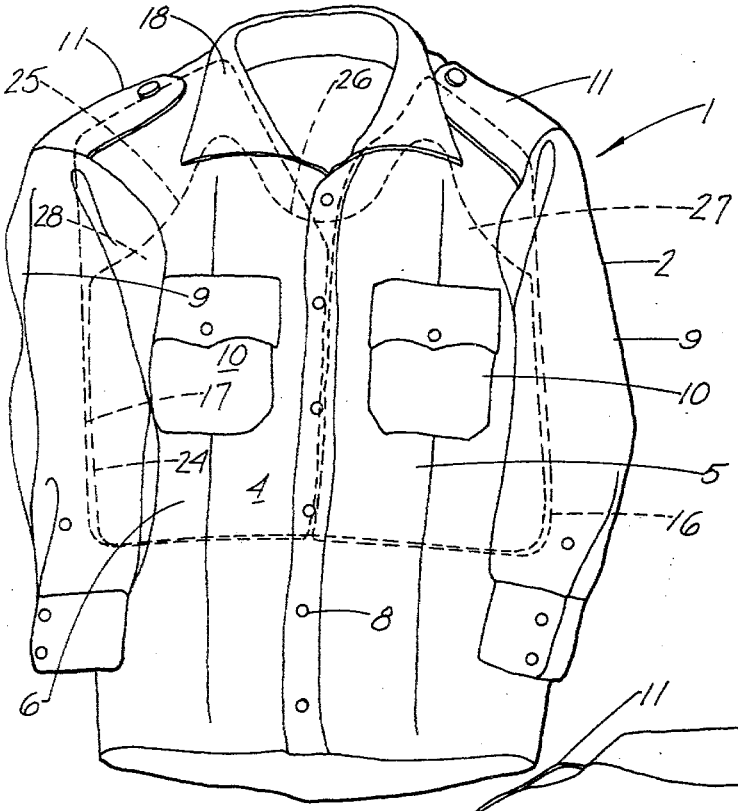
FIG. 1 is a front elevation view of the bullet resistant ballistic panel carrier garment of the present invention with the front portion closed.
Figure 2:
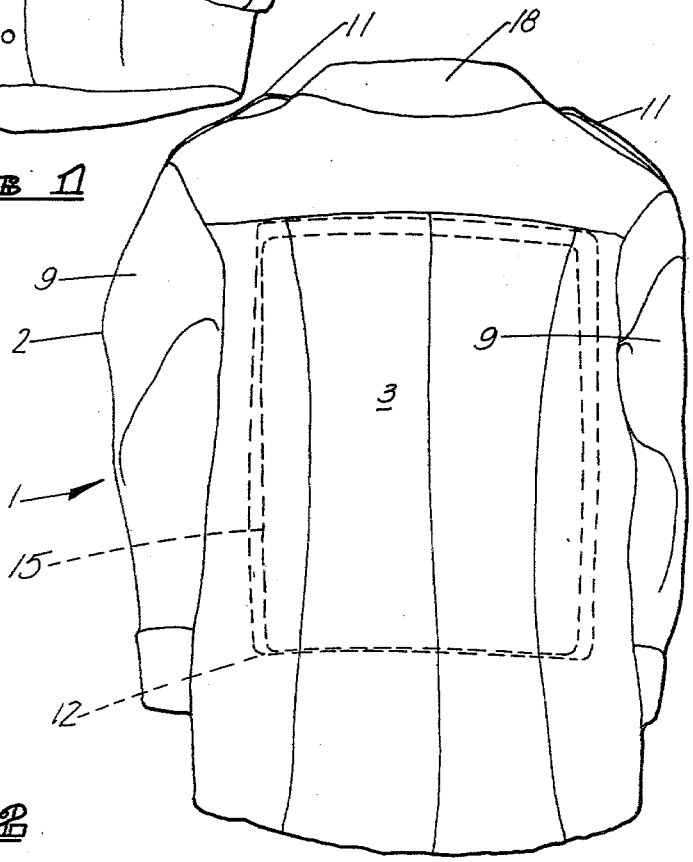
FIG. 2 is a rear elevation view of the bullet resistant ballistic panel carrier garment of the present invention.

FIG. 1 illustrates a front view of the bullet resistant ballistic panel carrier garment of the present invention, shown generally at 1. In general, carrier garment 1 comprises a shirt-like carrier garment 2, which may be designed to closely resemble a standard law enforcement officer's uniform shirt. However, it will be understood that any shirt or shirt-like garment may be adapted to include the carrier features of the present invention.

Shirt-like garment 2 includes a substantially continuous back portion 3 and a closable front portion 4 forming a left half chest section 5 and a right half chest section 6. Means are also provided, such as zipper 7, for closing the front portion. A row of buttons, one of which is illustrated at 8, may also be provided as desired to produce the necessary shirt-like appearance. However, it will be understood that other types of closing means, such as buttons and button holes, VELCRO, hooks and eyes, etc., may also be provided in particular situations. It will be further understood that shirt-like garments with substantially continuous front portions and no closing means are also contemplated to be within the scope of the present invention.

For purposes of an exemplary showing, a shirt-like garment 2 having long sleeves 9, front pockets 10, and epaulets 11, has been illustrated. However, it will be understood that other types of shirt-like garments having short sleeves, or various other types of attachments, or fabricated in a vest-like design, are contemplated to be within the scope of the present invention.

Figure 3:
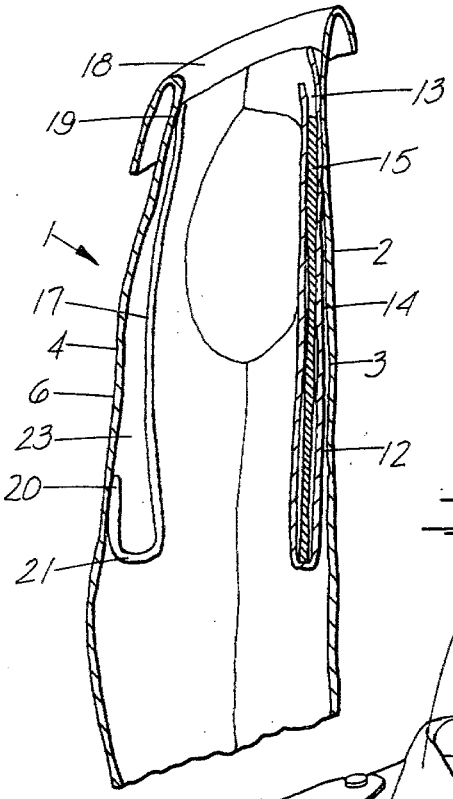
FIG. 3 is a fragmentary side elevation view, partially in cross section, of the bullet resistant ballistic panel carrier garment of the present invention.
Figure 4:
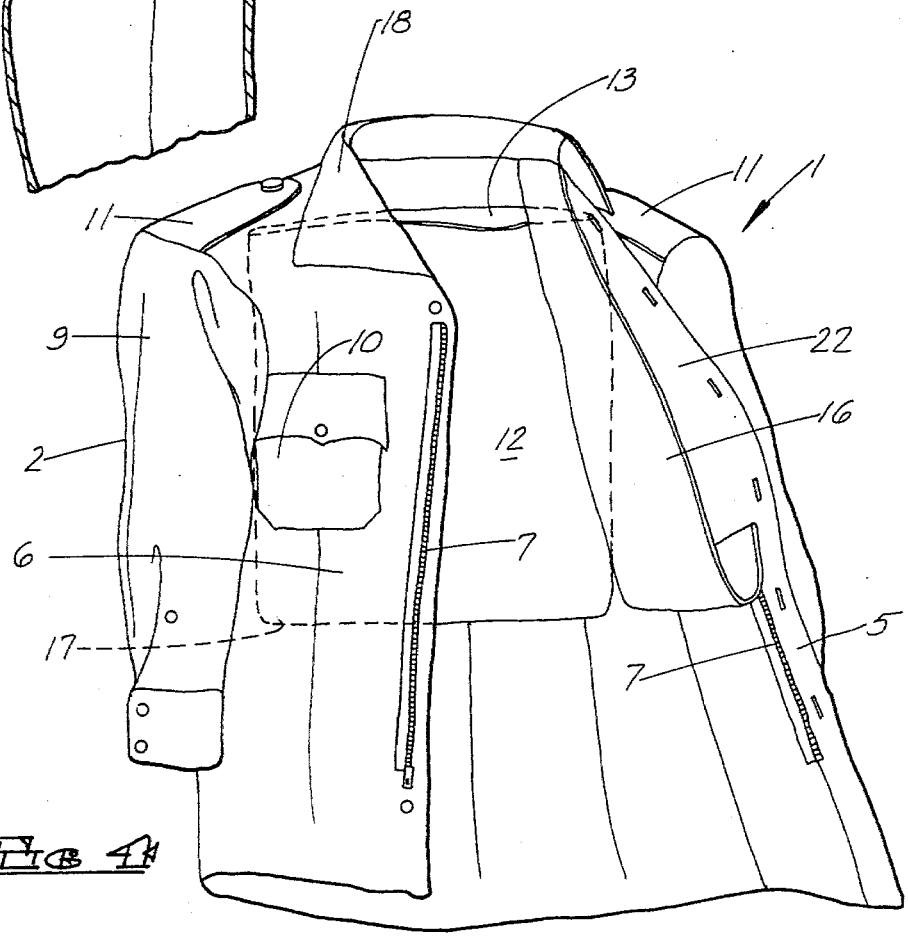
FIG. 4 is a front elevation view of the bullet resistant ballistic panel carrier garment of the present invention with the front portion of the garment partially opened to reveal the rear ballistic panel receiving receptacle and the left front ballistic panel receiving receptacle.

As best shown in FIG. 3–FIG. 4, a rear pocket-like rectangular-shaped ballistic panel receiving receptacle 12, which may be formed of cloth or the like, and which contains an opening 13 is provided along the upper edge of the receptacle. Receptacle 12 is attached to the inner surface of back portion 3 by sewing or the like along a line adjacent opening 13, so that the lower portion of receptacle 12 hangs freely within garment 2 to form a slight air space 14 between the rear surface of receptacle 13 and the inner surface of back portion 3. Air space 14 assists in reducing blunt trauma to the wearer, caused by ballistic impact against the rear of carrier garment 1. Furthermore, air space 14 facilitates air circulation between receptacle 12 and back portion 3, adding to the wearer's comfort.

A flexible rear bullet resistant ballistic panel 15 is slidably and removably received in rear receptacle 12 to provide protection for the upper rear torso of the wearer. For purposes of an exemplary showing, ballistic panel 15 may be of the type manufactured by A & B Industries, Inc., of Cincinnati, Ohio under the trademark Top-Line Soft Body Armor. This type of ballistic panel is constructed of a plurality of layers of KEVLAR yarn fabric, manufactured by E. I. DuPont de Nemours and Company, and covered with a polyurethane coated nylon covering. Such ballistic panels are capable of meeting or exceeding such Threat Levels as defined by the National Institute of Law Enforcement and Criminal Justice Standard 0101.01 (NILECJ-STD—0101.01). In general, it is preferred that ballistic panel 15 and receptacle 12 be dimensioned to cover at least 75% of the upper rear torso of the wearer.

Front rectangular-shaped pocket-like ballistic receiving receptacles 16 and 17 are attached to the inner surfaces of left chest section 5 and right chest section 6, respectively. Each front receptacle, which may be fabricated of cloth or the like, is attached at its upper edge adjacent to collar 18 of shirt-like garment 2, as at 19, so that its lower edge extends along a horizontal line positioned approximately midway on the front sections 5 and 6 of shirt-like garment 2 as at 20. As best shown in FIG. 3, the lower end of each of the front receptacles forms a loop portion 21 extending below attachment point 20. Front receptacles 16 and 17 are each provided with a vertically extending opening 22 and 23, respectively, which are aligned in facing relationship with each other when front portion 4 is closed to produce a substantially continuous receptacle extending across the front of garment 2. Although for purposes of an exemplary showing, front receptacles 16 and 17 have been attached to front sections 5 and 6 as at 19 and 20, it will be understood that a free-hanging construction, such as that employed for rear receptacle 12, may also be employed as desired to reduce blunt trauma and increase the comfort of the wearer.

As best shown in FIG. 1, a flexible front bullet resistant ballistic panel 24 is slidably and removably received in front receptacles 16 and 17, with a portion of panel 24 being supported by each of the front receptacles. Panel 24 has been omitted from FIG. 3 and FIG. 4 for clarity. This construction permits panel 24 to form a substantially continuous protective ballistic barrier across the upper front torso of the wearer when the front portion of garment 2 is closed. Panel 24 may be constructed in a manner similar to that described hereinbefore for rear ballistic panel 15. In some instances it may be desirable to shape front panel 24 as at 25 or 26 to accommodate the arms or neck, respectively, of the wearer, as is well understood in the art. In addition, front ballistic panel 24 may also be shaped as required to accomodate a female torso. In general, it is preferred that front receptacles 16 and 17, and ballistic panel 24 be dimensioned to protect at least 75% of the upper front torso of the wearer. Receptacles 12, 16 and 17 will normally be dimensioned to easily accept their associated ballistic panels, and may be shaped as required to conform to the shape of a contoured panel, to provide full coverage of the wearer's upper torso. In some instances, it has been found advantageous to tailor the size of the panels and receptacles to individual wearer's specifications. It is also preferred that the receptacle be dimensioned to closely conform to the enclosed panel, in order to prevent lateral shifting of the panel, which could leave unprotected portions of the upper torso, as well as prevent bunching or doubling-over of the panel within the receptacle.

In operation, rear ballistic panel 15 is slipped into receptacle 12 through opening 13. Garment 2 is then put on in the customary manner, with closing means 7 left unfastened, and front portion 4 opened to the approximate position shown in FIG. 4. One end of the front ballistic panel 24 is then slipped into the corresponding front receptacle. The other end of the front panel is similarly slipped into its associated receptacle, and front sections 5 and 6 drawn together so that fastening means 7 may be closed. In removing the garment, the reverse procedure is followed.

It will be understood that in those situations when ballistic protection is not required, shirt-like garment 2 may be worn without the enclosed ballistic panels. Furthermore, the surfaces of panels 15 and 24 may be covered with a smooth material to facilitate insertion in their respective receptacles.

It will be understood that various changes in the details, materials, steps and arrangements of parts, which have been herein described and illustrated in order to explain the nature of the invention, may be made by those skilled in the art within the principal and scope of the invention as expressed in the appended claims.

The embodiments of the invention in which an exclusive property or privilege is claimed are as follows:

1. A bullet resistant ballistic panel carrier garment comprising a shirt-like carrier garment having a back portion and a front portion, wherein said front portion includes left and right closable chest sections and means for closing said sections, a rear pocket-like ballistic panel receiving receptacle, means attaching said rear receptacle to the inner surface of said back portion, whereby at least the lower portion of said rear receptacle swings freely from said back portion and forms an air space between said rear receptacle and the adjacent inner surface of said back portion, and a front pocket-like ballistic panel receiving receptacle, said front receptacle comprising left and right ballistic panel receiving receptacles, means attaching said front left and right receptacles to the inner surfaces of said left and right chest sections, respectively, whereby at least the lower portions of said left and right receptacles swing freely from said left and right chest sections and form an air space between said left and right receptacles and the corresponding inner surfaces of said left and right chest section, said left and right receptacles including a vertically positioned opening along one edge thereof such that said openings are in substantially aligned facing relationship with each other when said garment is being worn.

2. The garment according to claim 1 wherein said rear receptacle includes an opening along one edge thereof for slidably receiving a ballistic panel.

3. The garment according to claim 1 including a ballistic panel received in said front receptacle such that the ends of said panel are supported by said left and right receptacles respectively.

4. The garment according to claim 1 including a ballistic panel received in at least one of said receptacles.

5. The garment according to claim 4 wherein said ballistic panel is constructed of a plurality of layers of flexible fabric-like material.

6. The garment according to claim 1 wherein at least one of said receptacles is sized to receive a ballistic panel dimensioned to protect at least 75% of the associated upper torso of the wearer.

7. The garment according to claim 1 wherein said receptacles are dimensioned to prevent shifting of an enclosed ballistic panel.

8. Bullet resistant protective wearing apparel comprising:

a shirt-like carrier garment having a substantially continuous back portion, a closable front portion forming left and right chest sections, and means for closing said front portion;

a rear pocket-like rectangular-shaped ballistic panel receiving receptacle having an opening along its top edge, said receptacle being attached to the inner surface of said back portion along the edge adjacent to said opening, whereby at least the lower portion of said rear receptacle swings freely from said back portion and forms an air space between said rear receptacle and the adjacent inner surface of said back portion such that said opening is horizontally disposed when said garment is being worn;

a front rectangular-shaped pocket-like ballistic panel receiving receptacle having an opening along the edge thereof attached to the inner surface of each of said left and right chest sections, respectively, whereby at least the lower portion of said front receptacle swings freely from said front portion and forms an air space between said receptacle and the adjacent inner surface of said left and right sections, said front receptacle openings being in aligned facing relationship with each other when said garment is being worn;

a flexible rear bullet resistant ballistic panel slidably and removably received in said rear receptacle, said rear panel and associated receptacle being dimensioned to protect at least 75% of the upper rear torso of the wearer; and a flexible front bullet resistant ballistic panel slidably and removably received in said front receptacles, a portion of said front panel being supported by each of said front receptacles, said front panel and associated receptacles being dimensioned to protect at least 75% of the upper torso of the wearer.

9. The garment according to claim 8 wherein said ballistic panels are constructed of a plurality of layers of flexible fabric-like material.

* * * * *